United States Patent [19]

Snider

[11] 4,127,142

[45] Nov. 28, 1978

[54] SLOW CLOSE HYDRANT CHECK VALVE

[75] Inventor: James A. Snider, 5761 Chelton Dr., Oakland, Calif. 94611

[73] Assignee: James Allen Snider, Oakland, Calif.

[21] Appl. No.: 795,926

[22] Filed: May 11, 1977

[51] Int. Cl.[2] ..... E03B 9/04; F16K 17/36; F16K 37/00

[52] U.S. Cl. ..... 137/68 R; 137/285; 137/551; 251/50; 285/3

[58] Field of Search ..... 137/68 R, 272, 282–285, 137/289, 291, 294–300, 329.2, 329.4, 513.3, 514; 251/50, 48

[56] References Cited

U.S. PATENT DOCUMENTS

| | | | |
|---|---|---|---|
| 1,169,401 | 1/1916 | Hodgson | 137/514 |
| 2,054,561 | 9/1936 | Greenberg | 137/285 X |

*Primary Examiner*—Martin P. Schwadron
*Assistant Examiner*—Richard Gerard
*Attorney, Agent, or Firm*—Flehr, Hohbach, Test, Albritton & Herbert

[57] ABSTRACT

A wet barrel hydrant check valve has a body containing a dash-pot assembly connected to a flapper valve, spring biased towards the closed condition. A sandwich flange fixed to the hydrant has a member holding the flapper out of the flow passageway, the flange being joined in a break-away connection to the valve body so that upon hydrant upset, as by vehicle impact, the hydrant and holding member are dismounted from the valve body, releasing the flapper into the flow path of escaping water for dash-pot controlled, gradual closure of the valve minimizing water hammer in the line.

4 Claims, 6 Drawing Figures

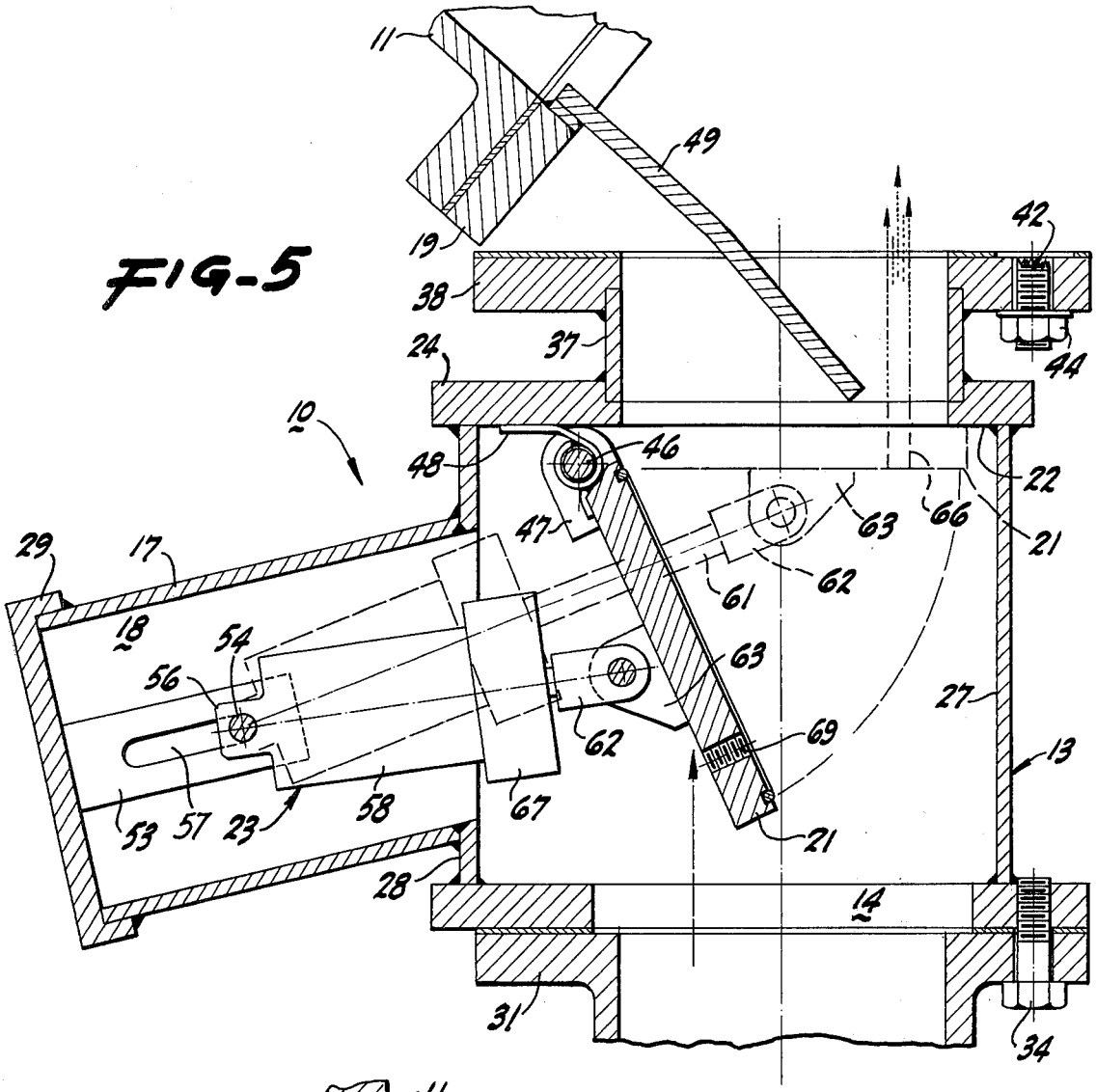
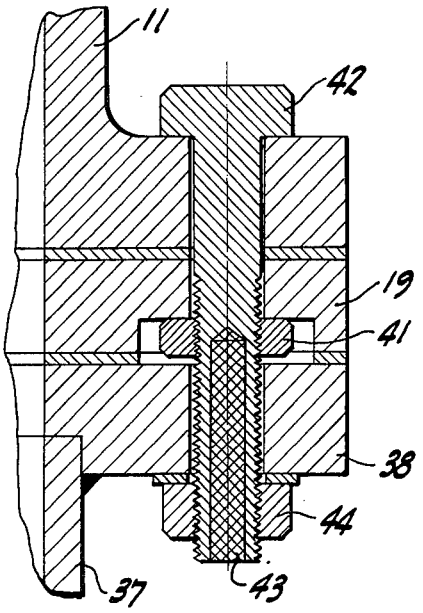
FIG-6

SLOW CLOSE HYDRANT CHECK VALVE

BACKGROUND OF THE INVENTION

This invention concerns an automatic shut-off valve for a wet barrel hydrant and is particularly directed to a valve structure which, when the hydrant is destroyed or disabled, closes off the uncontrolled flow of water therefrom in a manner which minimizes water hammer in the system lines.

In mild climates where ground freezing temperatures are rare and of short duration, the underground fire protection system of a municipality may employ fire hydrants having a manual shut-off valve located above ground. In this situation the hydrant itself holds water at the system pressure which may be in the range of 50 to 150 pounds per square inch. These hydrants are called wet barrel hydrants because a full head of water is always contained within them.

On occasion fire hydrants are damaged from impact by motor vehicles and frequently hydrants are sheared completely off the hydrant riser. To contain the resulting geyser as well as to conserve water in the system, automatic shut-off valves are provided in wet barrel hydrants and these have been constructed along the principles taught in the Greenberg Pat. No. 2,054,561, issued Sept. 15, 1936. There a breakable rod is recessed into the inside wall of the hydrant structure to hold in the non-operative position a flapper type check valve under spring bias. Should the hydrant be sheared from its support, the rod breaks to release the flapper type check valve which is urged by the spring into the out rushing water path and thus will slam the flapper against the valve seat very rapidly to halt the water flow. The abrupt closing of the automatic shut-off valve produces an enormous water hammer in the system and is known to have caused breakage in smaller lines connected in the system.

An important object of this invention is to provide an automatic hydrant shut-off valve structure which closes relatively slowly and serves to reduce almost entirely water hammer in the system.

Another object of the invention is to provide a hydrant shut-off valve of the type described which is mounted to the associated hydrant with a pressure proof but weakened connection providing a plane of preferential sheering when the hydrant receives destructive lateral impact.

Another object of the invention is to provide a hydrant shut-off valve of the type described which includes provisions for a "witness stream" visible to passers-by to signify the damaged fire hydrant.

Another object of the invention is to provide a "wet" hydrant shut-off or check valve of the type described which is readily installed and placed in operative condition both for new system installations and as a replacement in existing fire protection systems.

Another object of the invention is to provide a hydrant automatic check valve and connection assembly which breaks-away upon high impact and thereby reduces damage to the hydrant body.

Other objects and advantages of the invention will be apparent from the following detailed description considered with the accompanying drawings.

BRIEF DESCRIPTION OF THE DRAWINGS

FIG. 5 is a view like FIG. 2 but illustrates the sequence of movement occuring when the shut-off valve becomes operative, and FIG. 6 is a vertical sectional view in the direction of the arrows 6—6 of FIG. 3.

DESCRIPTION OF THE PREFERRED EMBODIMENT

Figure 1:
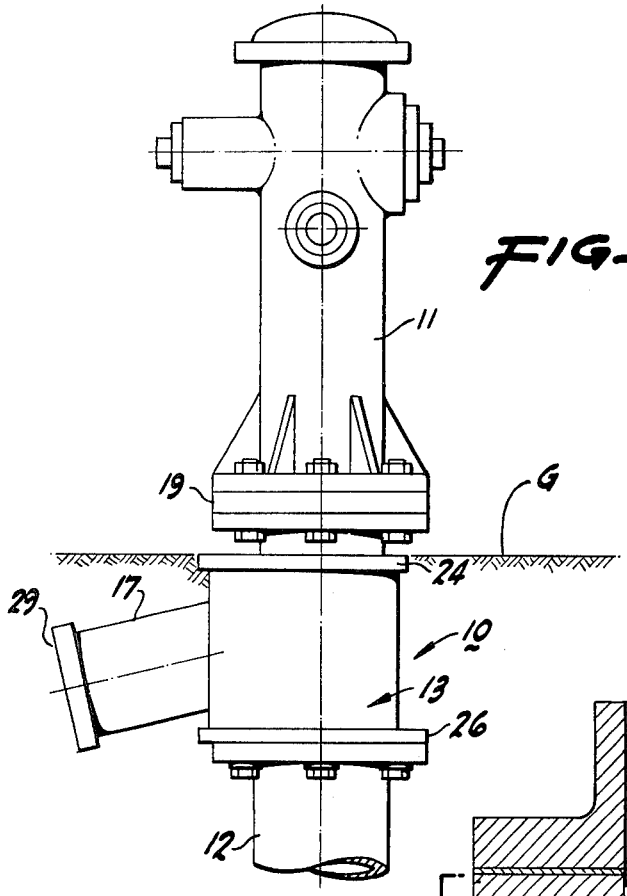
FIG. 1 is an elevational view of a wet barrel hydrant connected to the automatic hydrant shut-off valve of the present invention.

A preferred form of the improved automatic shut-off valve 10 incorporating the present invention is shown in FIG. 1 of the drawings in association with a wet barrel hydrant 11 and a hydrant riser 12 shown for fragmentarily but which represents a portion of a water distribution system for fire fighting. The fire hydrant 11 is equipped with a manual shut-off valve (not shown) located within the hydrant body above the level of grade G. Thus when the fire protection system is pressurized, the water level and hydrostatic pressure will extend into the hydrant body. This arrangement is known in the trade as a wet barrel hydrant.

Figure 2:
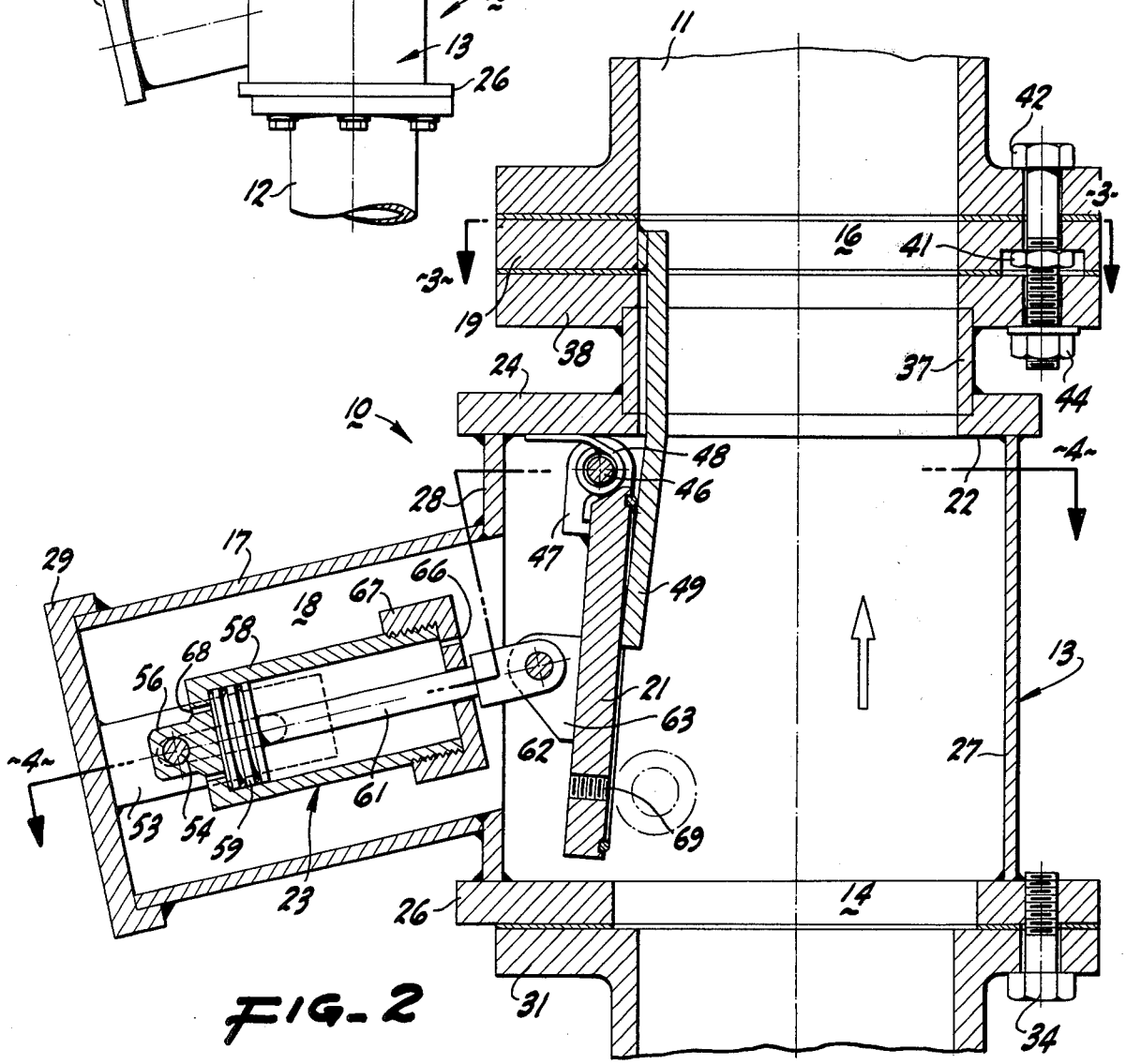
FIG. 2 is a greatly enlarged, partial vertical sectional view along the longitudinal center line of the structure in FIG. 1.
Figure 3:
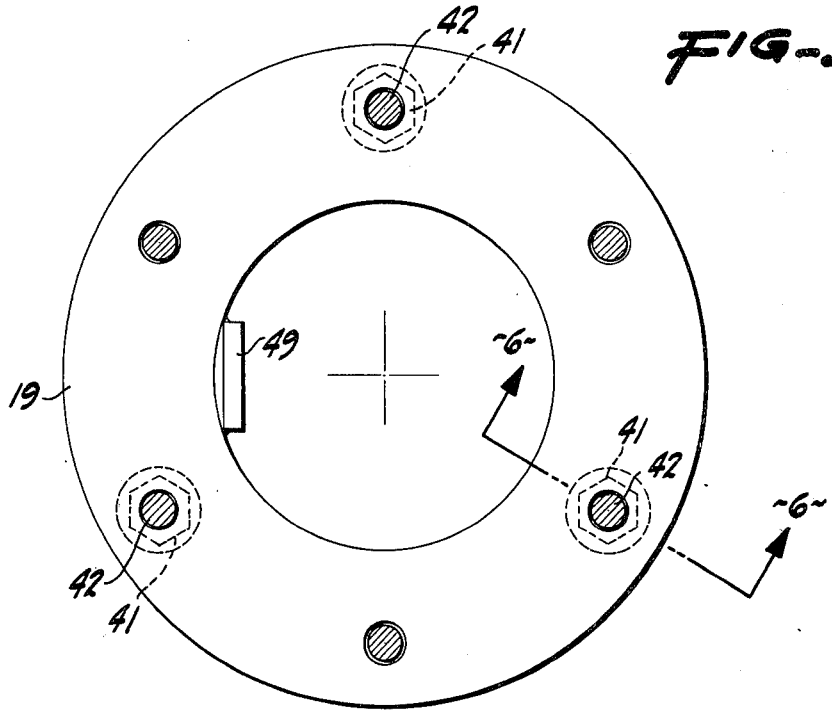
FIG. 3 is a view in the direction of the arrows 3—3 of FIG. 2.

Referring to FIG. 2, the improved, automatic shut-off valve 10 includes a valve body 13 having water inlet 14 and outlet 16 thereby to define a flow passageway through the valve. The valve body 13 is provided with wall structure 17 defining a chamber 18 or housing arranged laterally of the flow passageway, the chamber 18 being open to the valve body 13.

The shut-off valve 10 also includes a structure 19 for effecting a weakened connection with the hydrant 11, a valve flapper of closure member 21 with its associated O-ring seal 25 and valve seat 22, and a dash-pot mechanism 23 disposed in the chamber 18.

Figure 4:
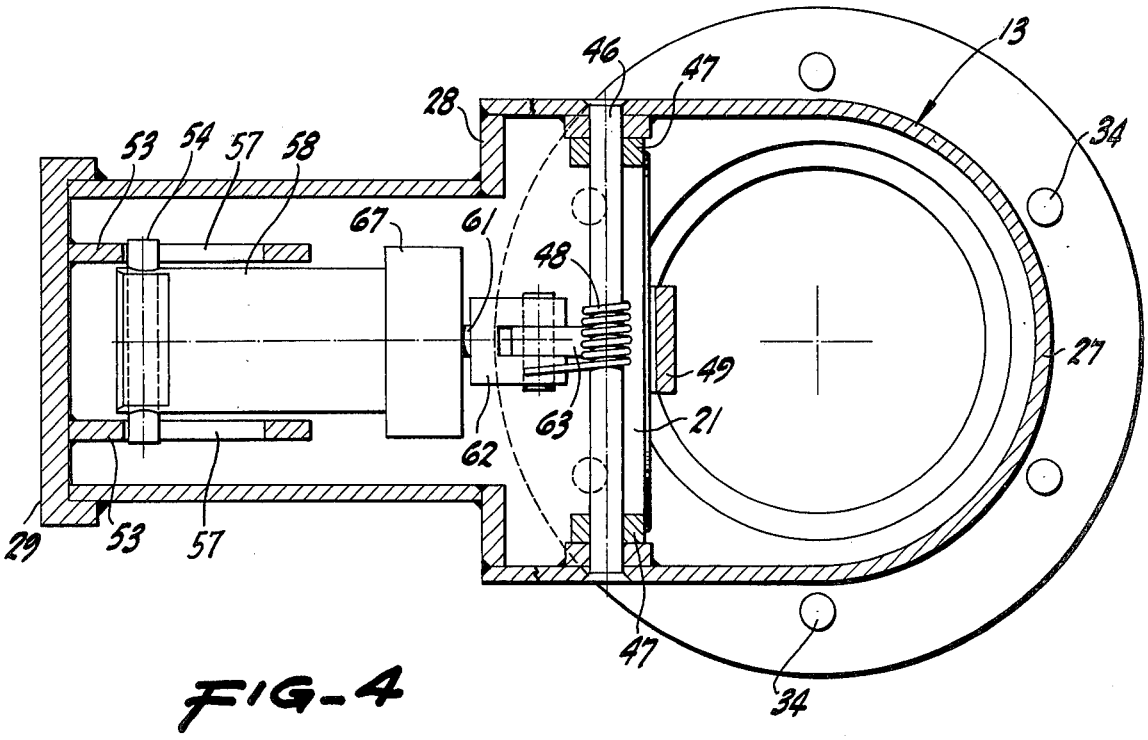
FIG. 4 is a sectional view in the direction of the arrows 4—4 of FIG. 2.

Considering now the structure of the valve body 13 in more detail, reference should be had to FIGS. 2, 4, and 5 where it will be observed that one satisfactory construction of the valve body is to make it as a steel weldment including upper 24 and lower 26 plates welded to curved side wall structure 27 all of which unite to the end wall structure 28 which receives the tubular wall structure 17 of the lateral chamber 18 and which is closed by an end cap 29. An alternative form of construction is by casting as is well known in this field.

The bottom plate 26 of the valve body is equipped to serve as a connecting flange and to be bolted to a flange 31 of the riser FIGS. 2 and 4. To this end there is provided four threaded apertures 32 and two threaded apertures 33 capped with seal plates 34 arranged adjacent to the chamber 18. By this arrangement the valve structure may be bolted to the riser flange 31 with conventional fasteners without obtaining access to the inside of the valve body.

The top plate 24 is equipped with a central collar 37 which is welded to a standard flange 38 drilled in the standard bolt pattern.

In mating the hydrant 11 with the shut-off valve 10, a break-away, connecting structure 19 is used. This serves to define the plane of shear breakage should the hydrant be struck, acts to preserve both the structure of the hydrant and that of the underlying shut-off valve and causes actuation of the shut-off valve. More specifically, referring to FIGS. 2, 3, 5, and 6 a "sandwich" flange 19 is provided with bolt holes drilled in the standard bolt spacings. A number of the holes in the flange 19 are counter-bored (FIG. 6) a depth permitting receipt of a jam-nut 41 and as compared to a standard bolt is weak in shear strength. The counter-bore is filled with caulking compound 43 for corrosion integrity. The jam-nut 41 and bolt 42 connect the sandwich flange 19 with the flange of the hydrant 11. The end of the break-away bolt is provided with a standard nut and washer 44 so as to join the hydrant, sandwich flange 19 and the top flange 38 of the valve body. The other three of the six bolt holes of the sandwich flange 19 are provided with break-away bolts 42 without the jam-nuts 41 illustrated in FIG. 6. Thus upon strong horizontal impact, shear occurs along the mating faces between the break-away flange and the valve body. The six break-away bolts shear because of the load permitting the hydrant to break-away from the valve body along the face of the break-away flange.

Referring to FIGS. 2 and 4, the valve closure member 21 is pivotaly mounted to one side to the valve body by means of a shaft 46 and lugs 47. A spring 48 of the hairpin type acting between the top plate 24 and valve flapper 21 serves to bias the latter towards the flow passageway. In the passive condition of the assembly 10, a bar 49 fixedly secured to the sandwich flange 19 and extending downwardly therefrom engages the valve flapper 21 holding it in a cocked position, against the bias of the spring 48, and out of the flow passageway.

The dash-pot mechanism 23 is mounted within the lateral chamber 18 and is united in a sliding connection at its outer end with the end cap 29 by means of a spaced pair of slotted ears 53 and cooperating sliding pin 54 received through a central lug 56 in the body of the unit. This arrangement permits the dash-pot mechanism to shift towards the flow passageway the distance of the slot 57 (compare FIGS. 2 and 5) in response to action of the spring 48 upon the valve flapper, the holding bar 49 being disengaged (FIG. 5) so as to place the dash-pot mechanism into a condition for operation.

The mechanism 23 comprises a cylinder 58 with an internal piston 59 equipped with a piston rod 61 connected by a clevis 62 to a lug 63 on one side of the valve flapper 21. In one preferred arrangement of the dash-pot, the piston chamber 64 on both sides of the piston is open to ambient water pressure within the valve body. Thus the piston chamber 64 can be charged through an orifice 66 in an end cap 67 of the cylinder. During charging, air and the like is discharged from the cylinder through an orifice 68 on the opposite side of the piston 59. The ratio of orifice area to piston area determines the restrictive rate of movement of the piston when drawn along the cylinder by the force of water acting upon the valve flapper 21, (FIG. 5), once the dash-pot mechanism has been shifted into active position by action of the spring 48.

The structure described above is an improved automatic shut-off valve for a wet barrel hydrant which controls the closure of the valve flapper 21 by means of a dash-pot member once the valve closure member has been released from the holding by 49. The closure of the valve is controlled by the resistance of the dash-pot acting against the water pressure on the valve flapper and through suitable selection of the orifice 66 area in the dash-pot, closures rates sufficient to eliminate virtually all water hammer damage to the system lines can be achieved.

Referring to FIG. 5 in more detail, a condition is indicated in solid lines where the hydrant 11 and break-away connection 19 have been knocked from the installed position upon the top flange 38 of the valve body shown in FIGS. 1 and 2. In FIG. 5 the hydrant carries with it the break-away flange which includes the holding bar 49. Here it should be understood that the break-away bolts 42 have sheared between flanges 19 and 38 from the impact force applied to the hydrant. The spring 48 urges the valve closure member 21 into the position shown in full lines in FIG. 5 and also pulls the dash-pot member into the position there indicated and there permitted by the slotted assembly 53. At this condition the dash-pot assembly becomes active in response to water pressure against the valve closure member and resists rapid closure of the valve flapper as water is discharged from the orifice 66 of the cylinder in response to piston movement. Ultimately the valve flapper will reach the condition of complete closure against the valve seat 22 where the O-ring 25 assists in effecting positive and complete seal. A witness hole 69 in the valve member 21 permits a stream of water to spurt forth from the valve so that passers-by will recognize the overturned hydrant and notify the authorities to come out and repair the condition.

Another function of the witness hole 69 is in charging or cocking of the shut-off valve with free standing water in the valve. Then a hook or eye bolt (not shown) is threaded into the witness hole. This eye bolt may be engaged with a hook like unit at the end of a pole (not shown) so that the valve closure 21 member may be pushed down to urge the piston 59 deep into the cylinder 58. This procedure is repeated a number of times to expel all air from the cylinder 23 and then the eye bolt is removed from the hole 69. The sandwich flange, with the holding rod 49, bolted to the hydrant may be mounted upon the top flange 38 of the valve for maintaining the closure member in the position shown in FIG. 2. The water pressure in the system may then be turned on so as to pressurize both the valve and hydrant.

It will be apparent to those having ordinary skill in the art that changes may be made in the details of the preferred embodiment disclosed above without departing from the spirit of the invention. Therefore the present invention shall not be limited except as defined in the claims which follow.

I claim:

1. A hammerless, automatic shut-off valve for cooperating with a wet barrel hydrant mounted downstream of the hydrant riser comprising, a shut-off valve body adapted to be mounted between the hydrant and the hydrant riser and having a flow passageway therethrough, a valve seat in the valve body about the flow passageway, a valve closure member pivotably mounted in the valve body laterally of the flow passageway and pivotable from an out-of-the-way position from the flow passageway to a closed position engaging said valve seat to close said flow passageway, holding means engaging said valve closure member for maintaining it in the out-of-the-way position, said holding means being mounted upon break-away structure active upon lateral impact to the hydrant serving to disengage said holding means from said closure member, spring means serving to bias said valve closure member towards the closed position, said valve body including a chamber disposed laterally of said flow passageway, dash-pot assembly means disposed in said chamber and acting between said valve body and said valve closure member serving to permit a controlled valve closure action upon disengagement of said holding means with said valve closure member, and connection means arranged between said dash-pot means and said valve body operatively permitting said dash-pot means to move as a unit toward the flow passageway in response to movement of the valve closure member into the flow stream to commence a damping action upon the valve closure member for gradual closing of the valve, said spring means serving to pivot said closure member into said flow passageway for impingement with the fluid stream moving therethrough.

2. The hydrant valve member of claim 1 wherein the dash-pot means is slidably and pivotably arranged by said connection means with respect to the valve body, said spring means serving to shift said dash-pot and valve closure member from a first out-of-the-way position into a second active position for controlled pivotal closure of the valve closure member.

3. The hydrant shut-off valve construction of claim 1 wherein said break-away structure includes flange means secured to said valve body, first shearable fastener means serving to interconnect hydrant structure downstream of said valve with said valve body and second shearable fastener means serving to interconnect the hydrant structure, flange means and valve body, said holding means being mounted upon said flange means, said flange means being fixably secured for movement with the hydrant structure upon impact with high lateral force tending to shear said first and second fastener means serving to shift said holding means from engagement with said valve closure member.

4. The hydrant shut-off valve of claim 1 wherein said closure member is provided with a witness hole therethrough to furnish a witness stream of water upon accidental dismounting of the associated wet barrel hydrant.

* * * * *